United States Patent [19]

Nurk

[11] 4,180,215

[45] Dec. 25, 1979

[54] THREAD STORAGE AND SUPPLY ARRANGEMENT FOR TEXTILE MACHINES

[75] Inventor: Siegfried Nürk, Albstadt, Fed. Rep. of Germany

[73] Assignee: Sipra Patententwicklungs- und Beteiligunsgesellschaft mbH, Stuttgart, Fed. Rep. of Germany

[21] Appl. No.: 944,376

[22] Filed: Sep. 21, 1978

[30] Foreign Application Priority Data

Sep. 29, 1977 [DE] Fed. Rep. of Germany ..... 2743749

[51] Int. Cl.[2] ..... B65H 51/20

[52] U.S. Cl. ..... 242/47.01; 139/452

[58] Field of Search ..... 242/47.01, 47.08, 47.09, 242/47.1, 47.11, 47.12, 47, 82, 83; 66/132 R; 139/452

[56] References Cited

U.S. PATENT DOCUMENTS

| | | | |
|---|---|---|---|
| 3,672,590 | 6/1972 | Rosen | 242/47.12 |
| 3,713,307 | 1/1973 | Muhlhausler | 242/47.01 X |
| 3,957,217 | 5/1976 | Clemens | 242/47.01 |
| 3,971,522 | 7/1976 | Pfarrwaller | 242/47.01 |

FOREIGN PATENT DOCUMENTS

| | | | |
|---|---|---|---|
| 1116486 | 6/1968 | United Kingdom | 139/452 |

*Primary Examiner*—Stanley N. Gilreath

*Attorney, Agent, or Firm*—Michael J. Striker

[57] ABSTRACT

The thread storage and supply arrangement comprises a storage drum having a peripheral thread storage surface onto which is to be wound a succession of adjoining turns of thread, the thread storage surface comprising a thread infeed region at one axial end of the storage surface and a thread outfeed region at the other axial end. A thread infeed structure located at the thread infeed region guides thread onto the peripheral storage surface to form a succession of adjoining turns of thread. A thread outfeed structure located at the thread outfeed region feeds off the storage drum thread which is to be pulled off. The peripheral storage surface, at the thread infeed region thereof, curves radially inward in the direction from the infeed to the outfeed region and, at the thread outfeed region thereof, curves radially outward in the direction from the infeed to the outfeed region. Relative rotation between the storage drum, on the one hand, and the infeed and outfeed structures, on the other hand, is effected by a controllable drive motor or by a controllable coupling which can be coupled to a continuously operated drive motor. An electrooptical control device activates and deactivates the motor or coupling in dependence upon the extent to which thread is wound about the peripheral storage surface of the storage drum.

8 Claims, 1 Drawing Figure

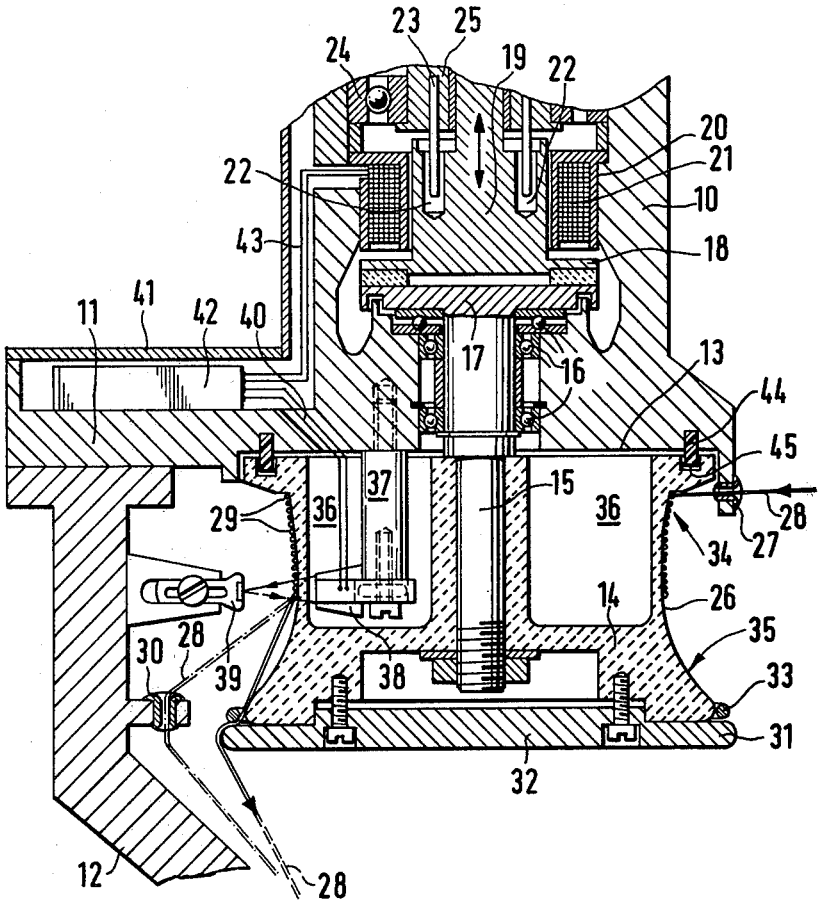
23
25
24
19
22
20
21
22
10
43
18
11
41
42
40
17
16
13
44
45
37
15
36
36
29
28
27
34
14
26
28
30
39
38
35
33
31
32
12
28

THREAD STORAGE AND SUPPLY ARRANGEMENT FOR TEXTILE MACHINES

BACKGROUND OF THE INVENTION

The present invention concerns thread storage and supply arrangements for textile machines, thread being understood to comprehend thread, yarn, filaments, and the like. In particular, the invention concerns storage and supply arrangements which comprise a storage drum whose peripheral surface narrows radially inward as one proceeds away from the thread infeed location of the arrangement, the peripheral surface of the drum serving to accommodate a plurality of neighboring turns of thread. Such storage drums can be coupled to a drive unit. A portion of the peripheral surface of the storage drum is transparent or translucent, and an optoelectronic device senses the degree to which the storage drum has been wound with thread. The storage and supply arrangement includes infeed and outfeed elements which respectively feed thread onto and off the peripheral surface of the storage drum, and the storage drum is provided with a drive arrangement for effecting relative movement between the storage drum and the infeed and outfeed elements.

Thread storage and supply arrangements are of course already known in a great variety of forms. An arrangement such as referred to above is disclosed in Federal Republic of Germany published allowed patent application DT-AS 1,288.229. A main problem with this prior-art arrangement resides in achieving an orderly shifting of the neighboring turns of thread on the peripheral surface of the storage drum in the direction towards the outfeed location. To achieve this, various rather complicated storage-drum constructions have been devised which very greatly increase the cost for such a thread storage and supply arrangement. The storage drums of the prior-art arrangements typically have, in the vicinity of the outfeed location, a circular-cylinder peripheral surface or else a conically narrowing peripheral surface which narrows in the direction towards the outfeed location, followed by a terminal larger-diameter outward bulge over the surface of which thread is pulled off. These arrangements operate satisfactorily with certain types of yarn, but cannot be utilized for the storing and supply of all types of yarn and thread without running into problems relating to the orderlines with which thread is wound onto and wound off the storage drum.

SUMMARY OF THE INVENTION

It is a general object of the present invention to provide a thread storage and supply arrangement of the type in question which, without costly structural complexity, assures an orderly winding of thread onto the supply drum and an orderly winding of thread off of the supply drum, for virtually all conventional types of yarn and thread, including for example crimped yarns and elastic threads.

In accordance with one concept of the present invention, the diameter of the storage drum at the thread outfeed end of its peripheral surface is larger than at the thread infeed end thereof. The radially inwardly tapering starting region of the peripheral surface curves inward and the radially outwardly expanding end region of the peripheral surface curves outward. The electrooptical monitoring device which monitors the degree to which the storage drum has been wound controls the driving of the storage drum, either by controlling the energization of the drive motor driving the drum or by controlling the energization of an electromagnetic coupling which when activated couples the drum to an uninterruptedly operating drive motor. Preferably, the peripheral surface of the drum is curved proceeding all the way from one to the other of its two ends, i.e., at no point having the shape of a circular cylinder.

The outwardly expanding end region of the storage drum's peripheral surface assures that, even with very smooth yarns, the turns of yarn at the middle region of the drum, if slipping down in the direction towards the outfeed location because of a lack of sufficient yarn tension, cannot fall over one another. The downwardly falling yarn layers are stopped at the outwardly curving end region of the peripheral surface and furthermore are even pushed up by subsequently wound-on turns of yarn to an extent such as to press them tightly against the surface of the drum. As a result, when pulling yarn off the drum, even in an intermittent manner, there is yarn tension immediately when the yarn starts to be pulled, because no loose yarn material lies on the drum surface such as could alter the yarn tensioning value. It has been found that, due to the curvature of the drum's peripheral surface, especially in the outwardly expanding end portion of the peripheral surface, the yarn wind-on or collecting conditions prevailing are extremely good for all standard types of yarn and thread, and when yarn is pulled off there is a proper degree of pull resistance at the pull-off location of the arrangement irrespective of what standard type of yarn or thread is involved.

The outwardly expanding and curving end region of the peripheral surface of the storage drum is not to be confused or equated with the conventional larger-diameter outward bulge normally provided at the outfeed end of such storage drums and across the surface of which yarn being pulled off is drawn; the conventional larger-diameter outward bulge forms no part of the peripheral storage surface of the storage drum. On the other hand, a conventional terminal pull-off bulge can be used in the context of the present invention, i.e., in addition to what has been described above, because it does facilitate the pulling-off of the yarn over the end edge of the storage drum.

The thread storage and supply arrangement of the present invention is relatively simple to construct. The storage drum can be rotated by the drive motor, with the infeed and outfeed thread-guiding elements stationary; alternatively, the storage drum can be stationary, with the infeed and outfeed thread-guiding elements orbiting about it. At the infeed end of the storage surface of the drum, the infeed-thread-guiding element, e.g., a thread-guiding eyelet, is advantageously so arranged as to be oriented radially with respect to the drum. In that event, the thead-guiding element can feed in thread identically irrespective of the direction in which the storage drum rotates relative to the thread-guiding elements, making the arrangement bi- or non-directional. The inventive thread storage and supply arrangement is suitable both for positive yarn infeed with continuous yarn pull-off under tension and also for intermittent yarn pull-off.

In the latter case, the relative movement as between the storage drum and the yarn-guiding elements is controlled by the aforementioned electrooptical device.

The inventive arrangement can be provided with an electric drive motor of its own or, for example, be driven off a drive belt serving to drive a plurality of such arrangements. In the latter case, the inventive arrangement is advantageously provided with an electromagnetic coupling and the electrooptical device controls the engagement and disengagement of such coupling.

The storage drum can advantageously be designed as a hollow drum made of transparent or translucent glass or plastic, with a combined light-emitting and light-receiving device located in the interior of the hollow transparent drum and cooperating with a mirror located exterior to the drum, this then constituting the aforementioned electrooptical device. Designing the electrooptical device in this way increases operating reliability quite advantageously, because the dust-sensitive elements of the device, e.g., light-emitting diodes and photodiodes, are protected from dust and other contamination within the interior of the transparent hollow drum, and the mirror located external to the drum is less susceptible to damage by such dust and if it collects dust tends much less to interfere with proper operation of the electrooptic device.

Preferably, the storage or contact surface of the storage drum is not a solid, uninterrupted surface. Instead, it is provided, for example, with axially extending elongated grooves or recesses interrupting the contact surface per se, facilitating the dropping down and away of slub and dust. Also contemplated by the present invention would for example, be cage-like storage drums having a succession of transparent (i.e., transparent or translucent) bars.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a schematic axial section through the inventive part of a preferred exemplary embodiment of the inventive thread storage and supply arrangement.

DESCRIPTION OF THE PREFERRED EMBODIMENTS

The FIGURE depicts the inventive part of one exemplary thread storage and supply arrangement embodying the present invention. Numeral 10 denotes a part of the housing of the arrangement and is provided with a laterally extending arm 11 secured to a carrier 12 which can be mounted on a textile machine. Located beneath the lower end wall 13 of housing 10 is a storage drum 14 cast from transparent (i.e., transparent or translucent) material. Storage drum 10 is secured to a ball-bearing mounted drive shaft 15 which extends down out from the housing 10.

The drive shaft 15, whose ball bearings are denoted by reference numeral 16, terminates in a coupling plate 17, the latter cooperating with an axially shiftable coupling plate 18 formed on the armature 19 of a magnetic coupling 20 provided with an energizing winding 21. At the end thereof opposite to the coupling disk 18, the armature 19 is provided with axially extending bores 22 into which engage axially extending motion-transmitting pins 23 carried on a hollow shaft 25 mounted by means of ball bearings 24. When winding 21 is energized, the coupling disks 17, 18 engage and couple the shaft 15 to a (non-illustrated) drive unit, for example to a drive belt which uninterruptedly rotates shaft 25.

The storage drum 14 has a peripheral surface 26 which curves along its entire axial length. Thread 28 (i.e., thread, yarn or filament) is fed, via an exactly radially oriented thread-guiding eyelet 27 mounted on housing 10, onto the peripheral surface 26 as a succession of adjoining turns of thread. Thread is laterally pulled off the storage drum 14 by means of, for example, an outfeed eyelet 30 mounted on the carrier 12. Alternatively, the pull-off of thread can be performed over the surface of an enlarged-diameter bulging end member 31, the latter being formed by the radially outer part of a plate 32 screwed onto the bottom of the storage drum 14. End member 31 is provided with a braking ring 33, the pulled-off thread passing under the braking ring 31 and then over the surface of end member 31. The curvature of the thread contact surface 26 of storage drum 14 is such that the surface 26 has a smaller diameter at its thread-infeed region 34 than at its thread-outfeed region 35.

A mounting bar 37 extends down from the end face 13 of housing 10 into the annular interior 36 of the hollow storage drum 14. Mounted on the bottom of bar 37 is a radially outward extending electrooptical unit 38. The latter comprises both a light-emitting diode and a photodiode (or other light transmitter and receiver). The light path of the emitted light extends outwardly through the transparent peripheral wall of the storage drum 14 to an external mirror 39 mounted on carrier 12, and is then reflected back through the wall of drum 14 onto the photodiode of electrooptical unit 38.

Electrooptical unit 38 is located in the middle region of storage drum 14. Its light path is interrupted as soon as the bottommost turn of thread on the contact surface 26 reaches this region. Electrooptical unit 38 is connected via lines 40 to an electronic switching circuit 42 mounted on the arm 11 of the housing 10 beneath covering wall 41. Switching circuit 42 has output lines 43 connected to the winding 21 of the electromagnetic coupling 20 for energizing and deenergizing the winding. As soon as thread has been wound onto the contact surface 26 of storage drum 14 down to the active region of electrooptic unit 38, the electromagnetic coupling 20 is energized and the coupling plate 18 moves axially upward out of engagement with the coupling plate 17 of the drive shaft 15 for the drum 14. As a result, the positive driving of storage drum 14 is interrupted. Then a number of turns of thread 29 are pulled off storage drum 14 such as to once again uncover optoelectrical unit 38, as a result of which electromagnetic coupling 20 is deenergized and the coupling plates 17, 18 engage once more. The electrooptical unit 38 is protected against dust because, in the annular gap between the storage drum 14 and the end face 13 of housing 10, a sealing ring 44 is anchored in an annular groove in the bottom end face 13 of housing 10. Sealing ring 44 extends downward into an annular groove 45 in the upper end face of rotating storage drum 14 and prevents dust from entering into the interior of drum 14 where the electrooptical unit 38 is located.

It will be understood that each of the elements described above, or two or more together, may also find a useful application in other types of constructions differing from the types described above.

While the invention has been illustrated and described as embodied in as involving a storage drum of particular design, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a thread storage and supply arrangement for textile machines, in combination, a storage drum having a peripheral thread storage surface onto which is to be wound a succession of adjoining turns of thread, the thread storage surface comprising a thread infeed region at one axial end of the storage surface and a thread outfeed region at the other axial end; thread infeed means located at the thread infeed region for feeding onto the peripheral storage surface a succession of adjoining turns of thread; thread outfeed means located at the thread outfeed region for feeding off the storage surface thread which is to be pulled off the storage drum, the peripheral storage surface at the thread infeed region thereof curving radially inward in the direction from the infeed region to the outfeed region and at the outfeed region thereof curving radially outward in the direction from the infeed region to the outfeed region, the diameter of the peripheral storage surface being greater at the part of the thread outfeed region remote from the infeed region than at the thread infeed region; controllable drive means operative when activated for effecting rotation of the storage drum relative to the infeed and outfeed means; and electrooptical control means operative for activating and deactivating-the drive means in dependence upon the extent to which thread is wound about the peripheral storage surface of the storage drum.

2. The arrangement defined in claim 1, the peripheral wall of the storage drum being transparent, the electrooptical control means being located at least in part radially inwardly of the transparent peripheral wall of the storage drum.

3. The arrangement defined in claim 1, the controllable drive means comprising a controllable coupling operative when activated for coupling the rotating one of the storage drum and infeed and outfeed means to a drive motor, the electrooptical control means controlling the controllable coupling.

4. The arrangement defined in claim 1, the peripheral storage surface of the storage drum curving along the entire axial length of the storage surface.

5. The arrangement defined in claim 1, the thread outfeed means including an enlarged-diameter pull-off member located at the axial end of the drum having the outfeed region, the pull-off member providing an annular surface across which thread being pulled off can be drawn, the enlarged-diameter pull-off member having a diameter larger than that of the outfeed region of the peripheral storage surface of the storage drum.

6. The arrangement defined in claim 1, the thread infeed means comprising a thread-guiding infeed eyelet mounted at the axial end of the peripheral storage surface having the infeed region, the infeed eyelet being oriented radially with respect to the peripheral storage surface, whereby to feed thread to the storage surface identically irrespective of the direction of rotation between the storage drum and the infeed and outfeed means.

7. The arrangement defined in claim 1, the storage drum being hollow and having a peripheral wall provided with the peripheral storage surface, the peripheral wall being comprised of transparent material, the electrooptical control means comprising a light-emitting element and a light-receiving element both located in the interior of the drum radially inward of the transparent peripheral wall, the electrooptical control means furthermore including an external mirror located radially outward of the transparent peripheral wall receiving light from the light-emitting element and reflecting received light to the light-receiving element.

8. The arrangement defined in claim 1, the arrangement including a housing having an end face, the storage drum having an axial end face located parallel to but spaced from the end face of the housing, the axial end face of the storage drum having an annular recess, furthermore including a sealing ring mounted on the end face of the housing and extending axially into the interior of the annular recess of the axial end face of the storage drum.

* * * * *